US011805856B2

(12) United States Patent
Chen

(10) Patent No.: US 11,805,856 B2
(45) Date of Patent: Nov. 7, 2023

(54) FASTENING DEVICE

(71) Applicant: Chin-Chu Chen, Taichung (TW)

(72) Inventor: Chin-Chu Chen, Taichung (TW)

( * ) Notice: Subject to any disclaimer, the term of this patent is extended or adjusted under 35 U.S.C. 154(b) by 0 days.

(21) Appl. No.: 17/271,602

(22) PCT Filed: Jul. 8, 2019

(86) PCT No.: PCT/CN2019/095132

§ 371 (c)(1),
(2) Date: Feb. 26, 2021

(87) PCT Pub. No.: WO2020/087976

PCT Pub. Date: May 7, 2020

(65) Prior Publication Data

US 2021/0186160 A1 Jun. 24, 2021

(30) Foreign Application Priority Data

Oct. 30, 2018 (CN) ..... 201811275429.6

(51) Int. Cl.
*A43C 11/20* (2006.01)
*B65H 75/48* (2006.01)
*B65H 75/44* (2006.01)

(52) U.S. Cl.
CPC ..... *A43C 11/20* (2013.01); *B65H 75/4434* (2013.01); *B65H 75/48* (2013.01); *B65H 2701/35* (2013.01)

(58) Field of Classification Search
CPC ..... A43C 11/20; A43C 11/165; A43C 11/00; A43C 11/16; A43C 7/00; Y10T 24/2183; Y10T 24/37
See application file for complete search history.

(56) References Cited

U.S. PATENT DOCUMENTS 6,015,110 A * 1/2000 Lai ..... H02G 11/02 242/396.9
7,367,522 B2 * 5/2008 Chen ..... A43C 7/00 242/378.1

(Continued)

FOREIGN PATENT DOCUMENTS

CN 1074357 A 7/1993
CN 1657388 A 8/2005

(Continued)

*Primary Examiner* — Robert Sandy
*Assistant Examiner* — Rowland Do
(74) *Attorney, Agent, or Firm* — CKC & Partners Co., LLC

(57) ABSTRACT

A fastening device including a case unit, a spool, a driving unit, a knob and a connecting unit is provided. The case unit has a radial direction and an axial direction and includes an annular wall. The annular wall surrounds an inner space. The spool is within the inner space and includes an axial space including a large-diameter segment and a small-diameter segment, and the small-diameter segment is connected to the large-diameter segment along the axial direction. The driving unit is disposed above the spool along the axial direction, and the driving unit selectively prohibits the spool from rotating in a loosening direction. The knob is disposed above the driving unit along the axial direction, and the knob is coupled to the driving unit. The connecting unit is connected to the knob, and the connecting unit is disposed within the axial space and limited within the large-diameter segment.

20 Claims, 11 Drawing Sheets

(56) References Cited

U.S. PATENT DOCUMENTS

| | | | | |
|---|---|---|---|---|
| 8,468,657 | B2 * | 6/2013 | Soderberg | A43C 1/06 242/395 |
| 8,516,662 | B2 * | 8/2013 | Goodman | B65H 75/4431 36/50.5 |
| 9,364,054 | B2 * | 6/2016 | Gittens | A43C 7/00 |
| 9,375,053 | B2 * | 6/2016 | Burns | A43C 7/08 |
| 9,770,070 | B2 * | 9/2017 | Cotterman | A43C 11/165 |
| 2005/0247813 | A1 * | 11/2005 | Kovacevich | A42B 3/08 242/395 |
| 2007/0084956 | A1 | 4/2007 | Chen | |
| 2010/0251524 | A1 * | 10/2010 | Chen | A43C 11/165 24/713.2 |
| 2010/0270413 | A1 | 10/2010 | Chien | |
| 2011/0191992 | A1 * | 8/2011 | Chen | A43C 11/16 24/713.2 |
| 2012/0228419 | A1 | 9/2012 | Chen | |
| 2013/0025100 | A1 * | 1/2013 | Ha | A43C 11/165 24/712.9 |
| 2014/0359981 | A1 | 12/2014 | Cotterman et al. | |
| 2015/0007422 | A1 * | 1/2015 | Cavanagh | A43C 11/165 29/434 |
| 2015/0230560 | A1 * | 8/2015 | Chen | A43C 11/20 24/68 SK |
| 2016/0058130 | A1 | 3/2016 | Boney et al. | |
| 2017/0042289 | A1 * | 2/2017 | Ha | A44B 99/00 |
| 2017/0295888 | A1 * | 10/2017 | Chen | A43C 11/165 |
| 2017/0303643 | A1 * | 10/2017 | Converse | A61C 7/026 |
| 2017/0325548 | A1 * | 11/2017 | Ha | A43C 11/165 |
| 2020/0337418 | A1 * | 10/2020 | Chen | B65H 75/4421 |
| 2020/0346888 | A1 | 11/2020 | Kruse et al. | |

FOREIGN PATENT DOCUMENTS

| | | | | |
|---|---|---|---|---|
| CN | 201015448 | Y | 2/2008 | |
| CN | 201718602 | U | 1/2011 | |
| CN | 203492894 | U | 3/2014 | |
| CN | 104906720 | A | 9/2015 | |
| CN | 204895922 | U | 12/2015 | |
| CN | 204969764 | U | 1/2016 | |
| CN | 206187398 | U | 5/2017 | |
| CN | 206499022 | U | 9/2017 | |
| CN | 206565397 | U | 10/2017 | |
| CN | 207061543 | U | 3/2018 | |
| CN | 111115388 | A | 5/2020 | |
| CN | 111115389 | A | 5/2020 | |
| CN | 111846339 | A | 10/2020 | |
| DE | 202016104318 | U1 | 11/2016 | |
| EP | 2269479 | A1 | 1/2011 | |
| JP | H07208 | A | 1/1995 | |
| JP | 3159620 | U | 5/2010 | |
| JP | 3202821 | U | 2/2016 | |
| JP | 2017513679 | A | 6/2017 | |
| KR | 1020160131296 | A | 11/2016 | |
| KR | 101862571 | B1 | 5/2018 | |
| TW | 201517828 | A | 5/2015 | |
| TW | M507670 | U | 9/2015 | |
| WO | 2011081261 | A1 | 7/2011 | |
| WO | 2014001918 | A2 | 1/2014 | |
| WO | WO-2015035885 | A1 * | 3/2015 | A43C 11/165 |
| WO | 2017/107724 | A1 | 6/2017 | |
| WO | 2017126876 | A1 | 7/2017 | |
| WO | 2017175586 | A1 | 10/2017 | |
| WO | 2018086068 | A1 | 5/2018 | |

* cited by examiner

FASTENING DEVICE

RELATED APPLICATIONS

This application is a continuation of International application No. PCT/CN2019/095132, filed Jul. 8, 2019, which claims the benefits of priority of CN application No. 201811275429.6 filed on Oct. 30, 2018, the content of which are incorporated herein by reference.

BACKGROUND

Technical Field

The present disclosure relates to a fastening device. More particularly, the present disclosure relates to a fastening device for securing an article through loosening or tightening a lace.

Description of Related Art

In daily life, cords, such as a lace or a thread, are usually used to tighten articles. The most common tightening method is to use the cord to reciprocately pass through holes on the article, such as eyelets of a shoe, and then tie a knot to secure the article. But in this kind of tightening method, the knot is loosened easily because of an external force. Not only does the knot need to be tied again, but also lots of inconveniences come owing to the insecurity of the articles.

In order to solve such problems, some practitioners developed a simple fastening mechanism including a case, a driving unit and a spring. The case includes holes configured for the lace to pass therethrough. Through the reaction force between the spring and the driving unit, the lace can be clamped between the driving unit and the case so as to be fastened. The length of the lace can be changed by pressing the spring to change the position of the driving unit. However, in such fastening mechanism, the restoring force of the spring is served as the securing force; thus, the lace is easily to be released owing to vibrations or an external force. In addition, the fastening mechanism has no space to receive the lace, and the exposure of the lace may bring danger.

Therefore, some practitioners developed another kind of buckle which can be rotated to tighten the lace, and the lace can be received inside the buckle. Through the interference between components inside the buckle, the length of the lace as well as the tightness can be adjusted. However, the structure of the buckles is complex; as a result, the manufacturing cost is increased, and the buckle has assembly and repair difficulty.

Hence, the inner structure of the buckle is continuously improved by the practitioners, with a hope that the structure can be simplified while the securing capability thereof is remained, and the structure reliability thereof is increased to prevent shortenness of the life time.

Based on the aforementioned problems, how to simplify the structure of the fastening device, reduce the manufacturing cost and maintain the securing capability becomes a pursuit target for practitioners.

SUMMARY

The present disclosure provides a fastening device, through the configuration of a spool and a connecting unit, the structure reliability thereof is increased.

According to one embodiment of the present disclosure, a fastening device is provided, which includes a case unit, a spool, a driving unit, a knob and a connecting unit. The case unit has a radial direction and an axial direction and includes an annular wall. The annular wall surrounds an inner space. The spool is within the inner space and includes an axial space. The axial space includes a large-diameter segment and a small-diameter segment, and the small-diameter segment is connected to the large-diameter segment along the axial direction. The driving unit is disposed above the spool along the axial direction, and the driving unit selectively prohibits the spool from rotating in a loosening direction. The knob is disposed above the driving unit along the axial direction, and the knob is coupled to the driving unit. The connecting unit includes a first part set and a second part set. The first part set is connected to the knob. The second part set inserts in the axial space to connect to the first part set, and the second part set is limited within the large-diameter segment.

Therefore, since the axial space of the spool includes the large-diameter segment and the small-diameter segment, the connecting unit can be limited within the large-diameter segment, and separation of the case unit, the spool, the driving unit and the knob during rotation can be avoided, thereby increasing the structure reliability.

According to examples of the aforementioned fastening device, the first part set can include a screw bar. The second part set can include a connecting barrel, and the connecting barrel includes a top portion and a barrel body portion. The barrel body portion is connected to the top portion. The barrel body portion passes through the small-diameter segment and is configured for the screw bar to screw therewith, and the top portion is limited within the large-diameter segment. Or the knob can include a boss protruding toward the inner space, and the barrel body portion is engaged with the boss, thereby allowing the connecting barrel to move simultaneously with the knob.

According to examples of the aforementioned fastening device, the first part set can include a fastening barrel. The second part set can include a stop ring and a screw bar. The stop ring is limited within the large-diameter segment, and the screw bar passes through the stop ring and the small-diameter segment to screw with the fastening barrel. Or the fastening barrel can include a lower engaging portion, and the stop ring can include an inner engaging groove configured for engaging with the lower engaging portion. Or the knob can include a boss protruding toward the inner space. The fastening barrel can include an upper engaging portion connected to the lower engaging portion, and the upper engaging portion is engaged with the boss. Or the fastening barrel can include a lower end surface, and after the screw bar is fastened with the fastening barrel, the stop ring abuts against the lower end surface.

According to examples of the aforementioned fastening device, the first part set can include a fastening barrel. The second part set can include a screw bar, and the screw bar includes a head portion and a bar portion. The bar portion is connected to the head portion. The bar portion inserts in the axial space to screw with the fastening barrel, and the head portion is limited within the large-diameter segment.

According to examples of the aforementioned fastening device, the case unit can further include an inner annular groove, which is disposed at a lower end of the annular wall. Or the case unit can further include a stop portion, which is located at the annular wall and protrudes toward the inner space along the radial direction, and the spool is located below the stop portion.

According to another embodiment of the present disclosure, a fastening device is provided, which includes a case unit, a spool, a driving unit, a knob and a connecting unit. The case unit has a radial direction and an axial direction and includes an annular wall. The annular wall surrounds an inner space. The spool is within the inner space and includes an axial space. The axial space includes a large-diameter segment and a small-diameter segment, and the small-diameter segment is connected to the large-diameter segment along the axial direction. The driving unit is disposed above the spool along the axial direction, and the driving unit selectively prohibits the spool from rotating in a loosening direction. The knob is disposed above the driving unit along the axial direction, and the knob is coupled to the driving unit. Operation of the knob causes the spool to release a lace. The connecting unit is connected to the knob, and the connecting unit is disposed within the axial space and limited within the large-diameter segment.

According to examples of the aforementioned fastening device, the connecting unit can include a first part set and a second part set. The first part set is connected to the knob. The second part set is disposed within the axial space to connect to the first part set, and the second part set is limited within the larger-segment. Or the first part set can include a screw bar. The second part set can include a connecting barrel, and the connecting barrel includes a top portion and a barrel body portion. The barrel body portion is connected to the top portion. The barrel body portion passes through the small-diameter segment and is configured for the screw bar to screw therewith, and the top portion is limited within the large-diameter segment. Or the knob can include a boss protruding toward the inner space, and the barrel body portion is engaged with the boss, thereby allowing the connecting barrel to move simultaneously with the knob.

According to examples of the aforementioned fastening device, the first part set can include a fastening barrel. The second part set can include a stop ring and a screw bar. The stop ring is limited within the large-diameter segment, and the screw bar passes through the stop ring and the small-diameter segment to screw with the fastening barrel. Or the fastening barrel can include a lower engaging portion, and the stop ring can include an inner engaging groove configured for engaging with the lower engaging portion. Or the knob can include a boss protruding toward the inner space. The fastening barrel can include an upper engaging portion connected to the lower engaging portion, and the upper engaging portion is engaged with the boss. Or the fastening barrel can include a lower end surface, and after the screw bar is fastened with the fastening barrel, the stop ring abuts against the lower end surface.

According to examples of the aforementioned fastening device, the first part set can include a fastening barrel. The second part set can include a screw bar, and the screw bar includes a head portion and a bar portion. The bar portion is connected to the head portion. The bar portion inserts in the axial space to screw with the fastening barrel, and the head portion is limited within the large-diameter segment. Or the case unit can further include a stop portion, which is located at the annular wall and protrudes toward the inner space along the radial direction. The spool is located below the stop portion.

DETAILED DESCRIPTION

The embodiment will be described with the drawings. For clarity, some practical details will be described below. However, it should be noted that the present disclosure should not be limited by the practical details. That is, in some embodiment, the practical details are unnecessary. In addition, for simplifying the drawings, some conventional structures and elements will be simply illustrated, and repeated elements may be represented by the same labels.

In addition, it will be understood that when an element (or mechanism or module) is referred to as being "disposed on", "connected to" or "coupled to" another element, it can be directly disposed on, connected or coupled to the other elements, or it can be indirectly disposed on, connected or coupled to the other elements, that is, intervening elements may be present. In contrast, when an element is referred to as being "directly disposed on", "directly connected to" or "directly coupled to" another element, there is no intervening element present. The terms first, second, third, etc. are used herein to describe various elements or components, these elements or components should not be limited by these terms. Consequently, a first element or component discussed below could be termed a second element or component.

Figure 1:
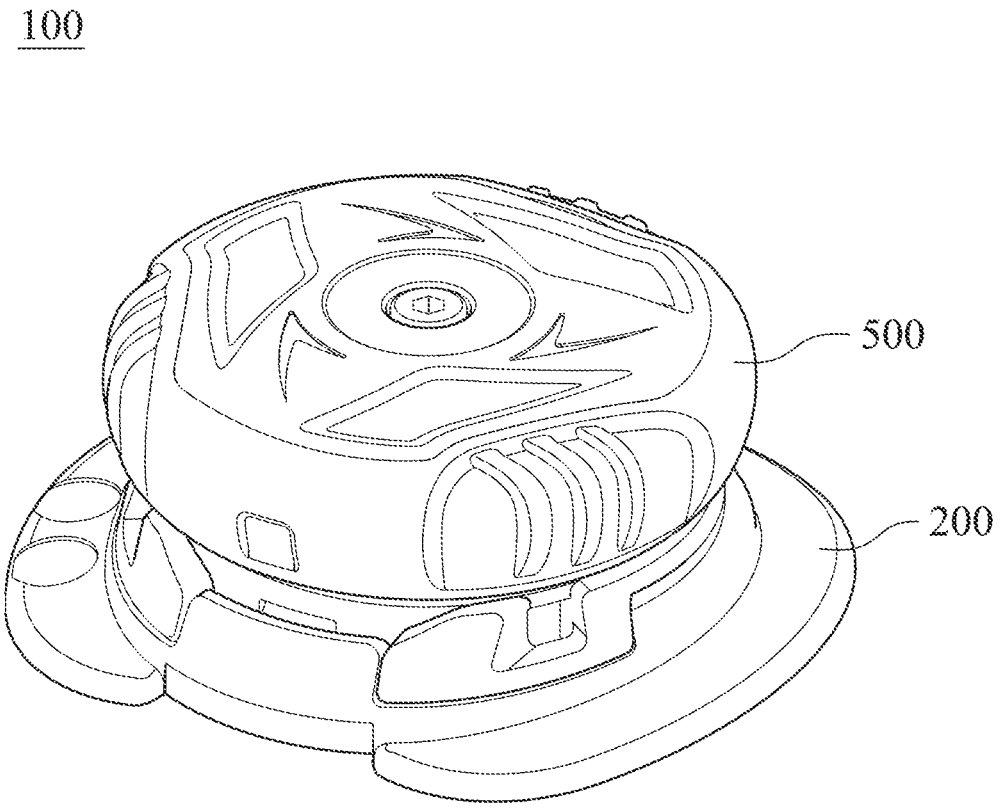
FIG. 1 shows a three-dimensional schematic view of a fastening device according to a first embodiment of the present disclosure.
Figure 2:
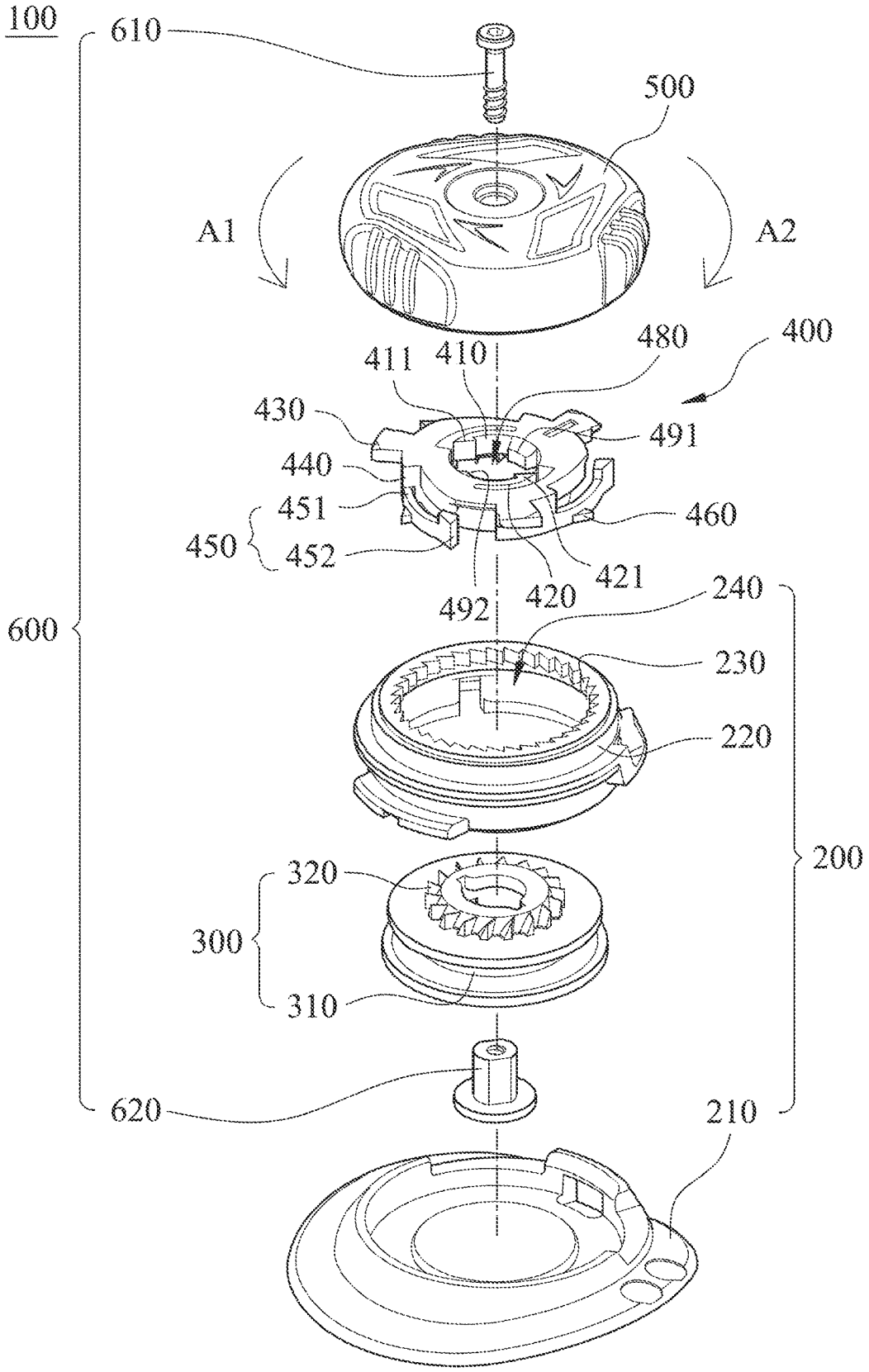
FIG. 2 shows one exploded view of the fastening device of FIG. 1.
Figure 3:
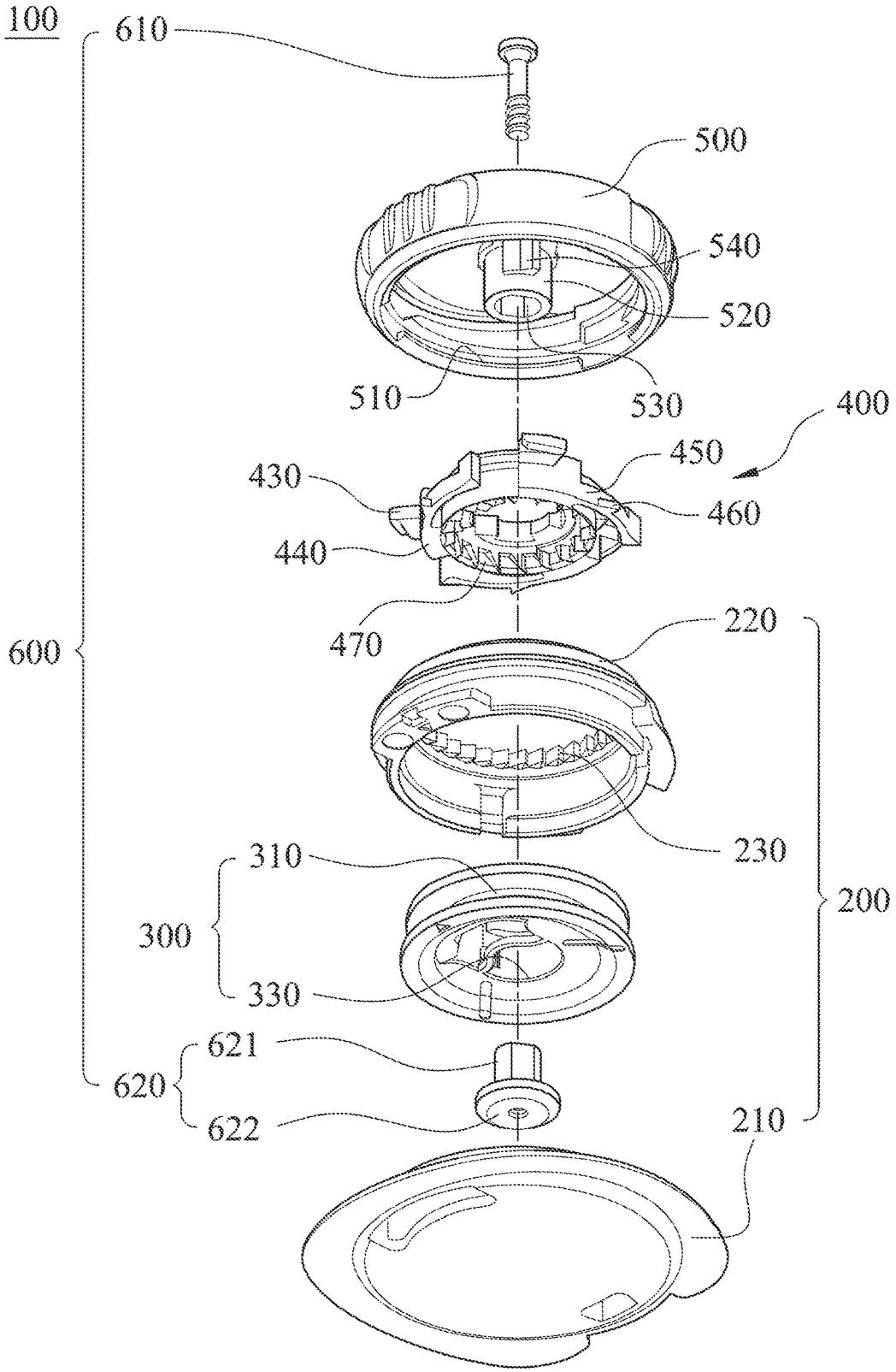
FIG. 3 shows another exploded view of the fastening device of FIG. 1.
Figure 4:
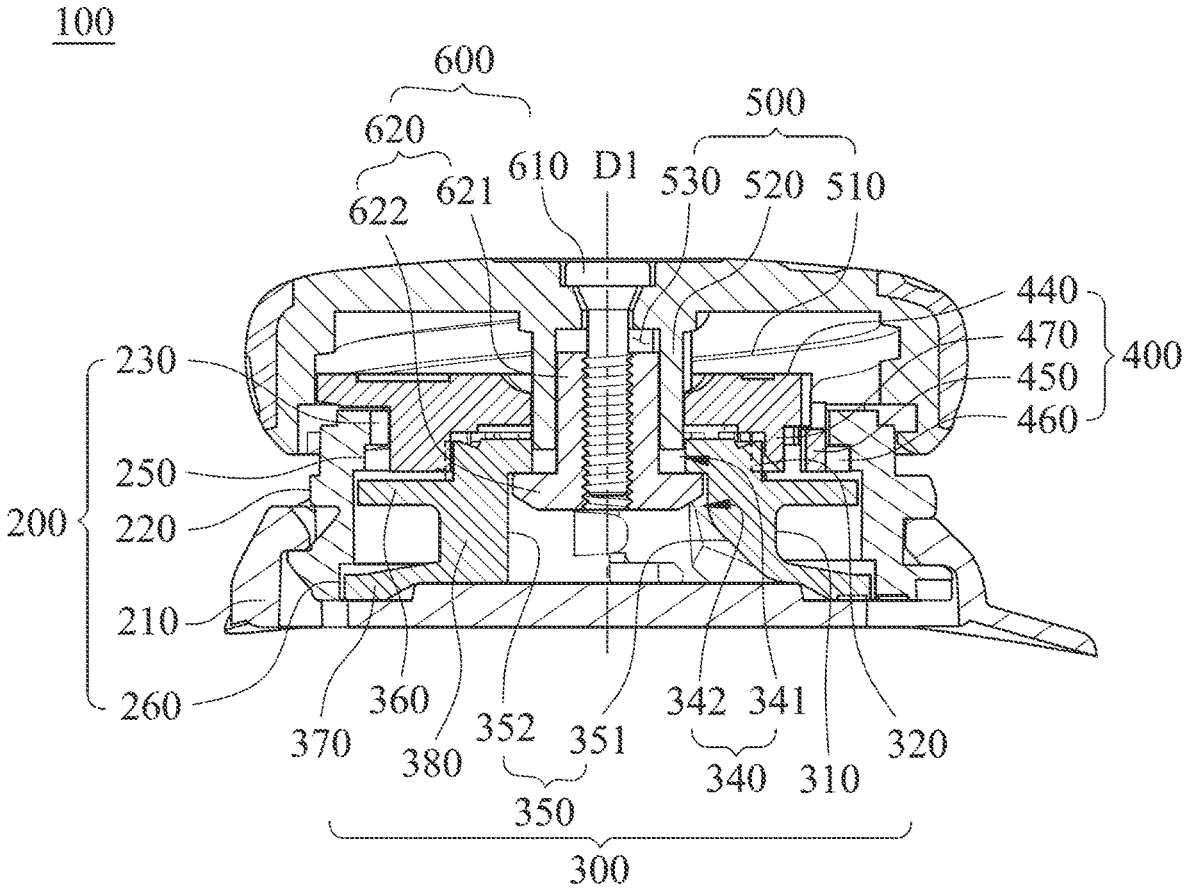
FIG. 4 shows one cross-sectional view of the fastening device of FIG. 1.
Figure 5:
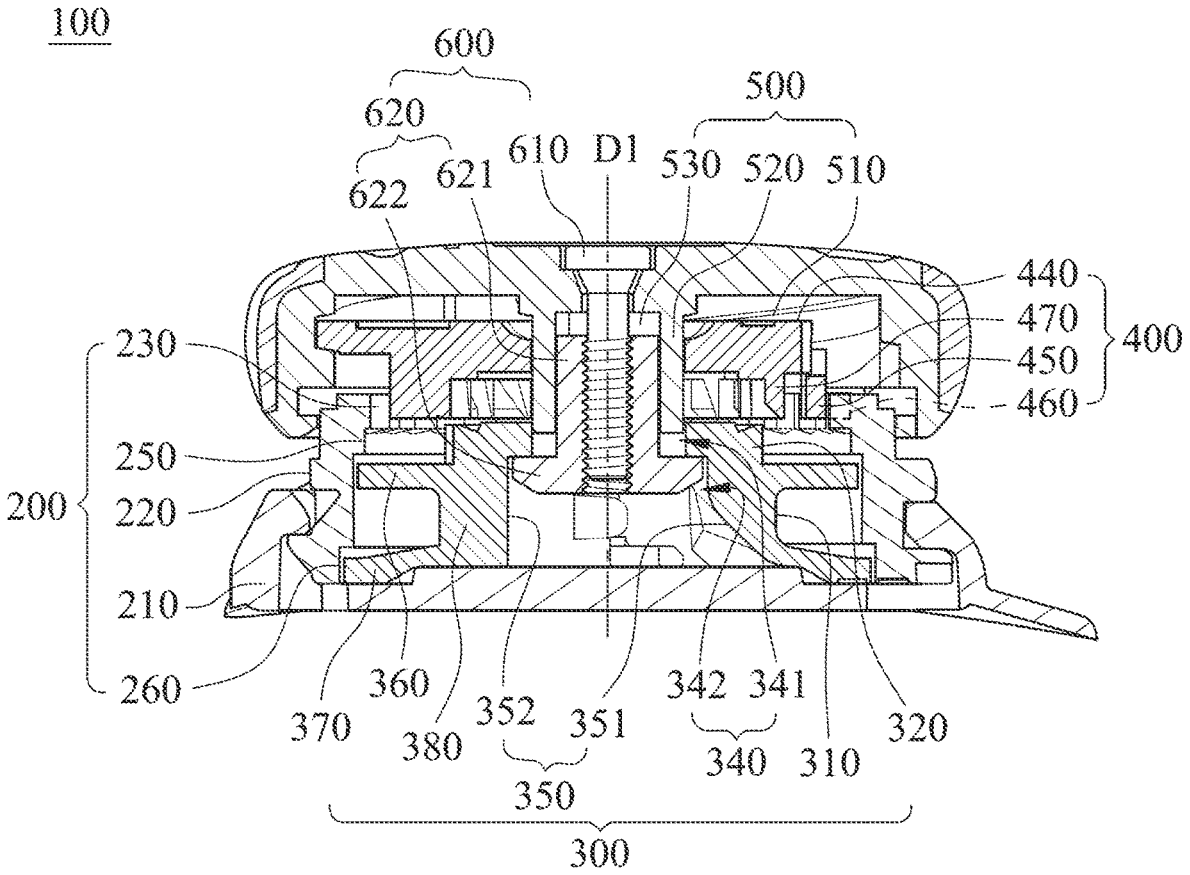
FIG. 5 shows another cross-sectional view of the fastening device of FIG. 1.

Please refer to FIGS. 1, 2, 3, 4, and 5. FIG. 1 shows a three-dimensional schematic view of a fastening device 100 according to a first embodiment of the present disclosure. FIG. 2 shows one exploded view of the fastening device 100 of FIG. 1. FIG. 3 shows another exploded view of the fastening device 100 of FIG. 1. FIG. 4 shows one cross-sectional view of the fastening device 100 of FIG. 1. FIG. 5 shows another cross-sectional view of the fastening device 100 of FIG. 1. The fastening device 100 includes a case unit 200, a spool 300, a driving unit 400, a knob 500 and a connecting unit 600.

The case unit 200 has a radial direction (not shown) and an axial direction D1 and includes an annular wall 220. The annular wall 220 surrounds an inner space 240. The spool 300 is within the inner space 240 and includes an axial space 340. The axial space 340 includes a large-diameter segment 342 and a small-diameter segment 341, and the small-diameter segment 341 is connected to the large-diameter segment 342 along the axial direction D1. The driving unit 400 is disposed above the spool 300 along the axial direction D1, and the driving unit 400 selectively prohibits the spool 300 from rotating in a loosening direction A1. The knob 500 is disposed above the driving unit 400 along the axial direction D1, and the knob 500 is coupled to the driving unit 400. The connecting unit 600 is connected to the knob 500, and the connecting unit 600 is disposed within the axial space 340 and limited within the large-diameter segment 342.

Therefore, since the axial space 340 of the spool 300 includes the large-diameter segment 342 and the small-diameter segment 341, the connecting unit 600 can be limited within the large-diameter segment 342, and separation of the case unit 200, the spool 300, the driving unit 400 and the knob 500 during rotation can be avoided, thereby increasing the structure reliability. The detail of the fastening device 100 will be described hereafter.

The case unit 200 can further include a stop portion 250, and the stop portion 250 is located at the annular wall 220 and protrudes toward the inner space 240 along the radial direction. The spool 300 is located below the stop portion 250. The case unit 200 can further include a base 210, a plurality of mounting teeth 230 and an inner annular groove 260. The base 210 is configured for the annular wall 220 to be disposed thereon, and the annular wall 220 can be assembled with the base 210 through engagements. The mounting teeth 230 are disposed at the annular wall 220 and face toward the inner space 240, and the inner annular groove 260 is located at a lower end of the annular wall 220. The mounting teeth 230 are located on an upper end of the annular wall 220. The stop portion 250 has a convex ring structure and is adjacent to the mounting teeth 230. In other words, the inner annular groove 260 and the stop portion 250 can be formed by the variation of the inner-diameter of the annular wall 220.

The spool 300 includes a hollow shaft 380, an upper annular portion 360 and a lower annular portion 370. The upper annular portion 360 and the lower annular portion 370 protrude outwardly from the hollow shaft 380 along the radial direction, respectively, and the upper annular portion 360 is located above the lower annular portion 370 along the axial direction D1, thereby allowing an annular track 310 to be formed between the upper annular portion 360 and the lower annular portion 370. The annular track 310 can be configured for a lace (not shown) to be wound thereabout. The spool 300 can include a plurality of engaging teeth 320 located above the upper annular portion 360 along the axial direction D1, and an inner surface 350 of the hollow shaft 380 is closed to form the axial space 340. The large-diameter segment 342 and the lower-diameter segment 341 connected thereto can be formed by the variation of the inner-diameter of the hollow shaft 380, and the large-diameter segment 342 is located below the small-diameter segment 341. The inner surface 350 of the hollow shaft 380 can include an expanding region 351 and a perpendicular region 352, and both of the expanding region 351 and a perpendicular region 352 are located at the large-diameter segment 342. The spool 300 can further include a lower opening 330 connected to the axial space 340.

The driving unit 400 can include a ring body portion 440, a first retaining portion 410, a second retaining portion 420, three guiding portions 430, three pawl arms 450, three restricting portions 460, a plurality of meshing teeth 470, a central hole 480 and two protrusions 491 and 492. The central hole 480 is located at a center of the ring body portion 440, and each of the guiding portions 430 has a helical tooth structure protruding outwardly from the ring body portion 440 and is configured to couple to the knob 500. The first retaining portion 410 and the second retaining portion 420 include a free end 411 and a free end 421, respectively. The free ends 411 and 421 can be displaced radially by a force, and can be restored after removing the force. The protrusions 491 and 492 protrude inwardly from the ring body portion 440, and the two protrusions 491 and 492 are spaced apart from the two free ends 411 and 421. Each of the pawl arms 450 includes a distal end 452 and a proximal end 451. The proximal ends 451 are configured to connect to an outside of the ring body portion 440, and the distal ends 452 are configured to selectively engage with the mounting teeth 230. The three restricting portions 460 are located above three pawl arms 450, respectively. The meshing teeth 470 are located at a lower side of the ring body portion 440, which can be selectively engaged with the engaging teeth 320 of the spool 300.

The knob 500 can include a guiding track 510, a boss 520, a through hole 530 and two positioning blocks 540. The guiding track 510 is located at an inner wall of the knob 500, and the boss 520 protrudes into the inner space 240 along the axial direction D1. The through hole 530 passes through the boss 520. The two positioning blocks 540 are disposed at an outside of the boss 520 along the radial direction. Please be noted that, only one position block 540 is shown in FIG. 3 owing to the view angle thereof, and it can be understood by a reader that, on the other side which cannot be seen, the other positioning block 540 is located.

The connecting unit 600 includes a first part set (not labeled) and a second part set (not labeled). The first part set is connected to the knob 500. The second part set is disposed within the axial space 340 to connect to the first part set, and the second part set is limited within the large-diameter segment 342. In the first embodiment, the first part set of the connecting unit 600 can include a screw bar 610. The second part set can include a connecting barrel 620, and the connecting barrel 620 includes a top portion 622 and a barrel body portion 621. The barrel body portion 621 is connected to the top portion 622. The barrel body portion 621 passes through the small-diameter segment 341 and is configured for the screw bar 610 to screw therewith, and the top portion 622 is limited within the large-diameter segment 342.

Precisely, when the spool 300 is put into the inner space 240 from the bottom of the annular wall 220, as shown in FIG. 4, the upper annular portion 360 and the lower annular portion 370 can be limited by the stop portion 250 and the inner annular groove 260, respectively, thereby avoiding the spool 300 from leaving from the upper side of the annular wall 220. The guiding portions 430 (shown in FIG. 3) are coupled to the guiding track 510 to connect the driving unit 400 to the knob 500. The boss 520 of the knob 500 protrudes into the central hole 480 (shown in FIG. 2) of the driving unit 400.

The connecting barrel 620 can be put from the lower opening 330 (shown in FIG. 3) into the axial space 340, and through the diameter relationship of the small-diameter segment 341, the large-diameter segment 342, the top portion 622 and the barrel body portion 621, the barrel body portion 621 can pass through the small-diameter segment 341 while the top portion 622 is limited within the large-diameter segment 342. Then, the screw bar 610 is fastened into the barrel body portion 621, and combination of the knob 500, the driving unit 400 and the spool 300 is completed. Because of the stop portion 250, after the screw bar 610 is fastened with the barrel body portion 621, the knob 500, the driving unit 400, the spool 300 and the annular wall 220 cannot separate from each other, thereby completing assembly. In other embodiments, the stop portion can be omitted; instead, the mounting teeth can protrude into the inner space to prevent the spool from leaving from the upper side of the annular wall. Moreover, only one of the stop portion and the inner annular groove is required to be disposed on the annular wall, and the present disclosure is not limited thereto.

Furthermore, the barrel body portion 621 can be engaged with the boss 520, thereby allowing the connecting barrel 620 and the knob 500 to move simultaneously. A shape of the outer wall of the barrel body portion 621 can coordinate with the inner wall of the through hole 530, which results in engagement between the barre body portion 621 and the boss 520. Moreover, the outer wall of the barrel body portion 621 and the inner wall of the through hole 530 are non-circular. When pulling the lace to rotate the spool 300 in a loosening direction A1, the spool 300 may rub against the second part set, and if the barrel body portion 621 of the second part set is engaged with the boss 520, rotation of the second part set caused by the friction from the spool 300 can be avoided, thereby avoiding it from separating from the first part set.

As shown in FIG. 4, the driving unit 400 is in the first position, and the engaging teeth 320 of the spool 300 are engaged with the meshing teeth 470 of the driving unit 400. The distal ends 452 (shown in FIG. 2) of each of the pawl arms 450 are engaged with the mounting teeth 230 in the loosening direction A1 (shown in FIG. 2) while disengaged from the mounting teeth 230 in a fastening direction A2 (shown in FIG. 2). The restricting portion 460 is not engaged with the mounting teeth 230 owing to that the location of the restricting portion 460 is lower than the mounting teeth 230. Hence, rotating the knob 500 in the fastening direction A2 can drive the driving unit 400 to allow the spool 300 to draw back the lace. When the knob 500 is immobile, the distal end 452 of each of the pawl arms 450 is abutted against the mounting teeth 230 to prevent rotation of the spool 300 in the loosening direction A1, thereby avoiding release of the lace.

On the contrary, rotating the knob 500 in a loosening direction A1 drives the driving unit 400 to move upward along the axial direction D1, such that the driving unit 400 is separated from the spool 300. To be more specific, when the driving unit 400 is in the first position, the guiding portions 430 are engaged with the guiding track 510 of the knob 500. One of the position blocks 540 is located between the free end 411 of the first retaining portion 410 and the protrusion 491, and the other one of the position blocks 540 is located between the free end 421 of the second retaining portion 420 and the protrusion 492. When the knob 500 is rotated in the loosening direction A1, the driving unit 400 cannot rotate simultaneously owing to the engagement between the pawl arms 450 and the mounting teeth 230, and therefore the two positioning blocks 540 press the two free ends 411 and 421, respectively, which allows the two free ends 411 and 421 to be displaced along the radial direction such that the knob 500 can rotate relative to the driving unit 400. The guiding portions 430 will be guided by the guiding track 510 to move upward relative to the guiding track 510 along the axial direction D1, allowing the driving unit 400 to switch to the second position. Hence, the aforementioned one of the positioning blocks 540 switches to a position between the free end 411 of the first retaining portion 410 and the protrusion 492, and the aforementioned the other one of the positioning blocks 540 switches to a position between the free end 421 of the second retaining portion 420 and the protrusion 491.

Hence, as shown in FIG. 5, when the driving unit 400 is in the second position, the meshing teeth 470 of the driving unit 400 will disengage from the engaging teeth 320 of the spool 300, and the spool 300 is not affected by the driving unit 400 and rotation in the loosening direction A1 is allowed; as a result, the lace can be released by pulling the lace itself.

Figure 6:
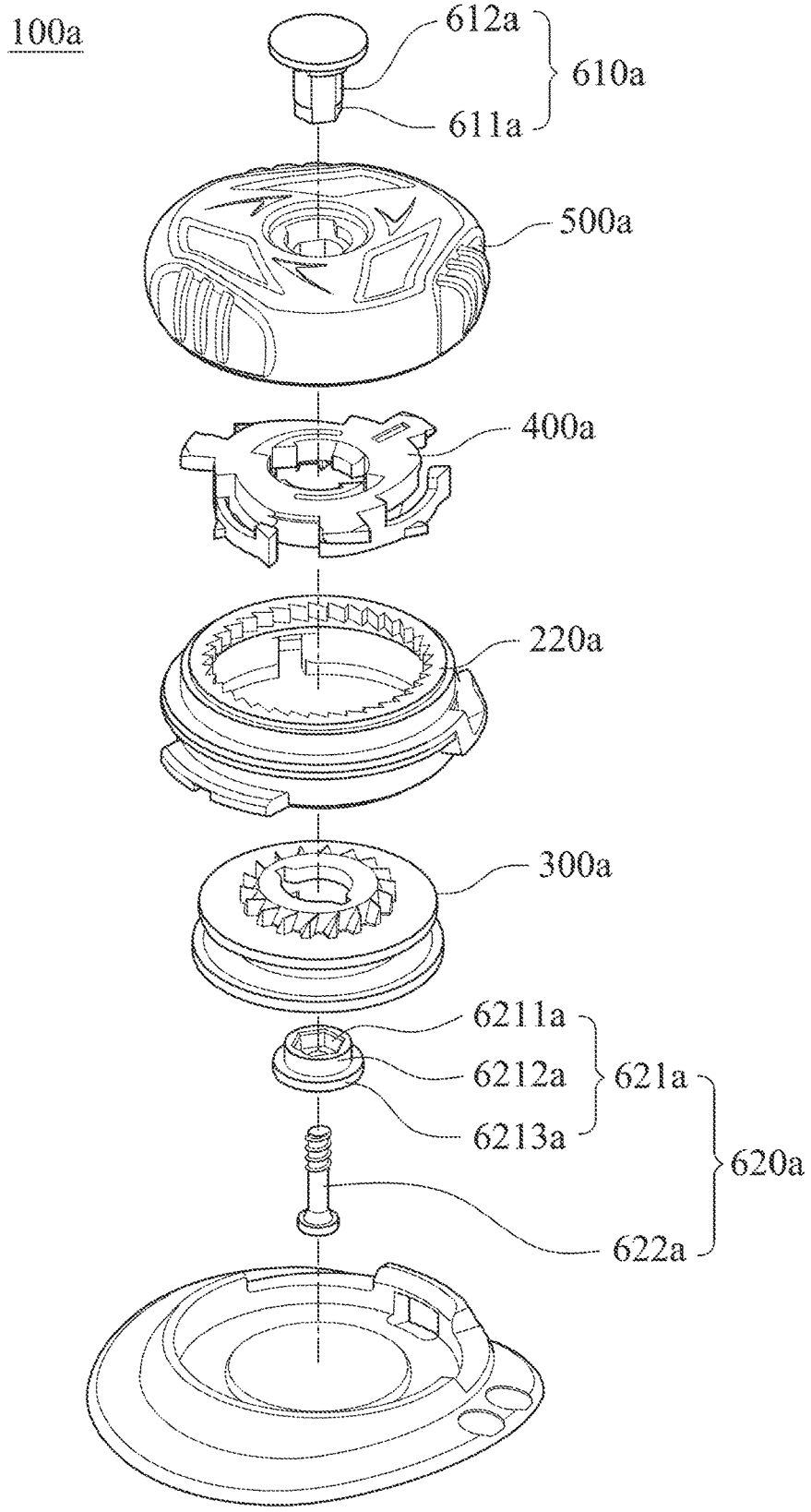
FIG. 6 shows a three-dimensional exploded view of a fastening device according to a second embodiment of the present disclosure.
Figure 7:
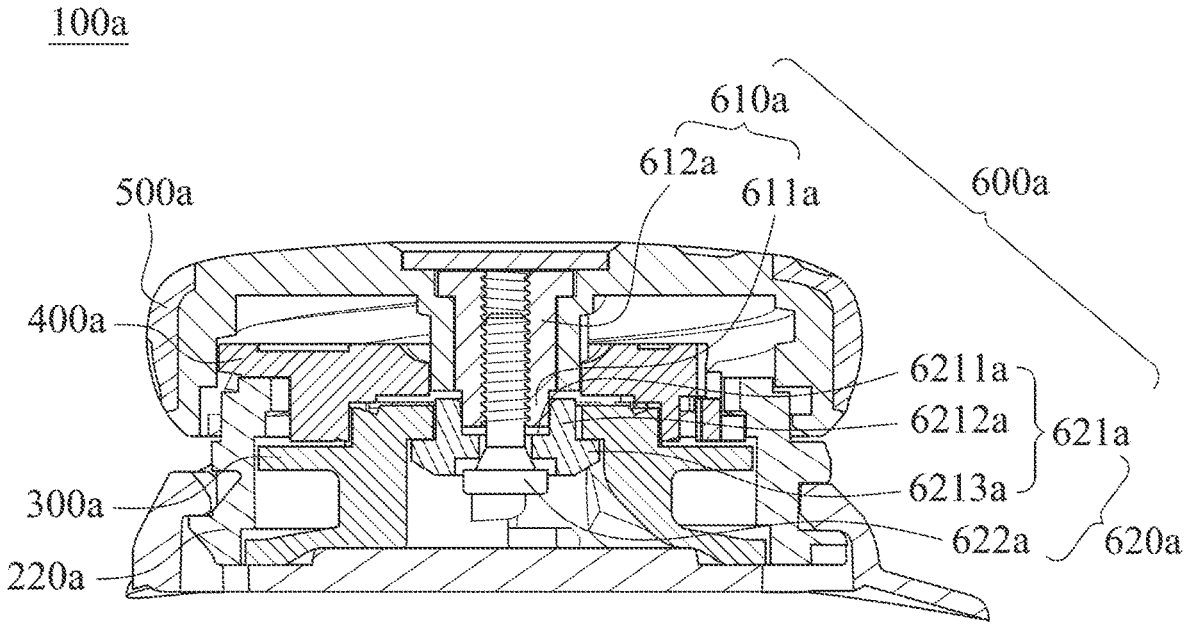
FIG. 7 shows a cross-sectional view of the fastening device of FIG. 6.

Please refer to FIG. 6 and FIG. 7. FIG. 6 shows a three-dimensional exploded view of a fastening device 100*a* according to a second embodiment of the present disclosure. FIG. 7 shows a cross-sectional view of the fastening device 100*a* of FIG. 6. The fastening device 100*a* includes a case unit (not labeled), a spool 300*a*, a driving unit 400*a*, a knob 500*a* and a connecting unit 600*a*. The structure and relation of the case unit, the spool 300*a*, the driving unit 400*a* and the knob 500*a* are similar to that of the case unit 200, the spool 300, the driving unit 400 and the knob 500 in the first embodiment, but the structure of the connecting unit 600*a* is different from the connecting unit 600 of the first embodiment.

The connecting unit 600*a* includes a first part set and a second part set 620*a*. The first part set includes a fastening barrel 610*a*. The second part set 620*a* includes a stop ring 621*a* and a screw bar 622*a*. The stop ring 621*a* is limited within the large-diameter segment (not labeled), and the screw bar 622*a* passes through the stop ring 621*a* and the small-diameter segment (not labeled) to screw with the fastening barrel 610*a*. The fastening barrel 610*a* can include a lower engaging portion 611*a*. The stop ring 621*a* includes an inner engaging groove 6211*a*, and the inner engaging groove 6211*a* is configured to engage with the lower engaging portion 611*a*. The knob 500*a* can include a boss (not labeled) protruding toward the inner space (not labeled) along the axial direction. The fastening barrel 610*a* can further include an upper engaging portion 612*a* connected to the lower engaging portion 611*a*, and the upper engaging portion 612*a* is engaged with the boss.

To be more specific, the stop ring 621*a* further includes a bottom portion 6213*a* and a body portion 6212*a*. The body portion 6212*a* is connected to the bottom portion 6213*a*, and the inner engaging groove 6211*a* is located at the body portion 6212*a*. The shape of the upper engaging portion 612*a* of the fastening barrel 610*a* fits the through hole (not labeled) of the boss, and the shape of the lower engaging portion 611*a* fits the inner engaging groove 6211*a*. Hence, when the fastening barrel 610*a* passes through the through hole, the upper engaging portion 612*a* is engaged with the boss, and the lower engaging portion 611*a* exposes from the boss to protrude toward the small-diameter segment.

In addition, as shown in FIG. 7, the body portion 6212*a* of the stop ring 621*a* passes through the small-diameter segment, and the inner engaging groove 6211*a* is engaged with the lower engaging portion 611*a*. The bottom portion 6213*a* is remained in the large-diameter segment to be limited within the larger segment, and the screw bar 622*a* can fasten into the fastening barrel 610*a* upward from a bottom side thereof along the axial direction, thereby completing combination of the knob 500*a*, the driving unit 400*a*, the spool 300*a* and the annular wall 220*a*. As pulling the lace to rotate the spool 300*a* in the loosening direction, the spool 300*a* may rub against the second part set 620*a*, and because the stop ring 621*a* of the second part set 620*a* is engaged with the boss through the fastening barrel 610*a*, rotation of the second part set 620*a* caused by the friction can be avoided, which also avoids separation between the first part set and the second part set 620*a*.

Figure 8:
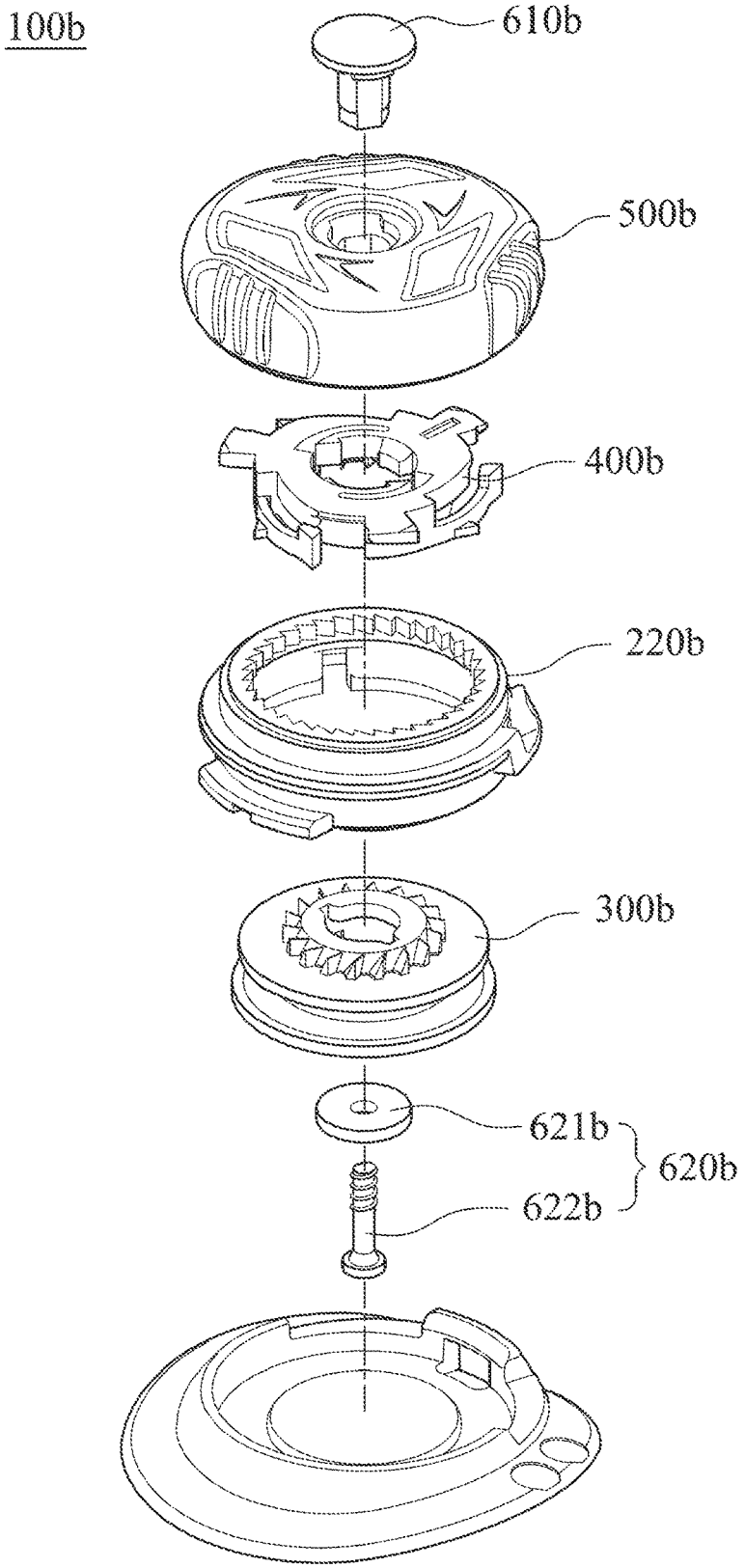
FIG. 8 shows a three-dimensional exploded view of a fastening device according to a third embodiment of the present disclosure.
Figure 9:
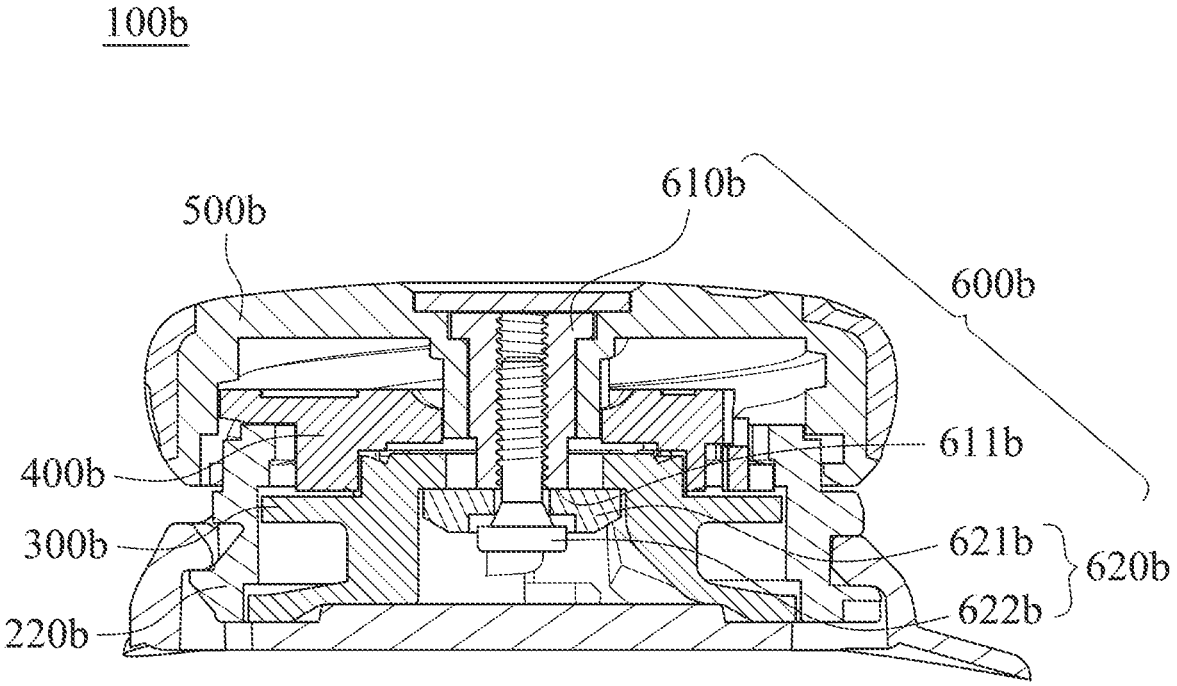
FIG. 9 shows a cross-sectional view of the fastening device of FIG. 8.

Please refer to FIG. 8 and FIG. 9. FIG. 8 shows a three-dimensional exploded view of a fastening device 100*b* according to a third embodiment of the present disclosure.

FIG. 9 shows a cross-sectional view of the fastening device 100*b* of FIG. 8. The fastening device 100*b* includes a case unit (not shown), a spool 300*b*, a driving unit 400*b*, a knob 500*b* and a connecting unit 600*b*. The structure and relation of the case unit, the spool 300*b*, the driving unit 400*b* and the knob 500*b* are similar to that of the case unit, the spool 300*a*, the driving unit 400*a* and the knob 500*a* in the second embodiment, but the structure of the connecting unit 600*b* is different from the connecting unit 600*a* of the second embodiment.

Precisely, the first part set of the connecting unit 600*b* includes a fastening barrel 610*b*, and the second part set 620*b* includes a stop ring 621*b* and a screw bar 622*b*. The structure of the fastening barrel 610*b* is identical to the fastening barrel 610*a* of the second embodiment, but the lower engaging portion is omitted while the length of the upper engaging portion along the axial direction is elongated to protrude into the small-diameter segment. The present disclosure includes the above but is not limited thereto. In the third embodiment, the stop ring 621*b* has a ring structure, and the fastening barrel 610*b* includes a lower end surface 611*b*. After the screw bar 622*b* is fastened into the fastening barrel 610*b*, the stop ring 621*b* is abutted against the lower end surface 611*b*, such that combination of the knob 500*b*, the driving unit 400*b*, the spool 300*b* and the annular wall 220*b* are completed. As pulling the lace to rotate the spool 300*b* in the loosening direction, the spool 300*b* may rub against the second part set 620*b*, and because the stop ring 621*b* is forced by the screw bar 622*b* to abut against the lower end surface 611*b*, the friction between the stop ring 621*b*, the screw bar 622*b* and the lower end surface 611*b* is larger than that between the spool 300*b* and the stop ring 621*b*; therefore, rotation of the second part set 620*b* caused by the friction can be avoided, which also avoids separation between the first part set and the second part set 620*b*.

Figure 10:
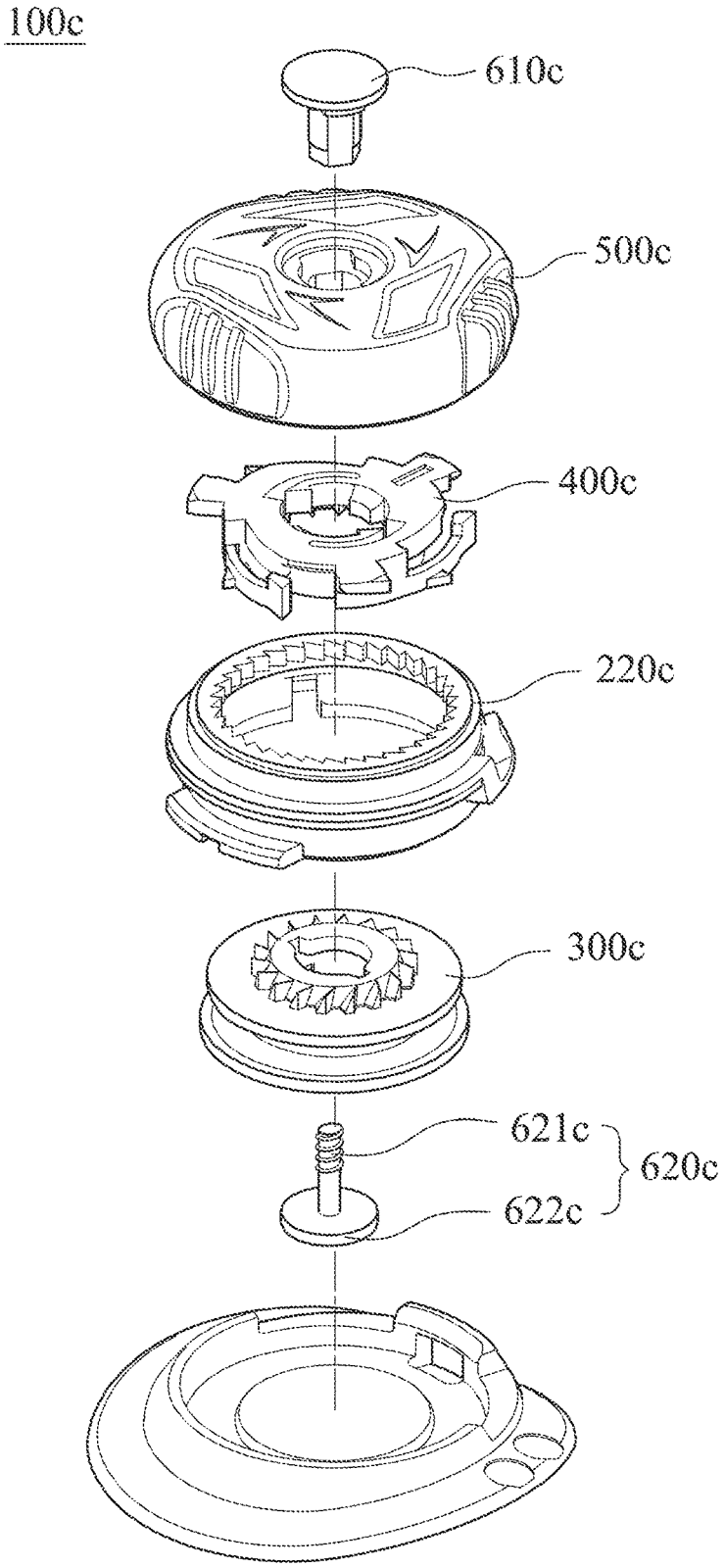
FIG. 10 shows a three-dimensional exploded view of a fastening device according to a fourth embodiment of the present disclosure.
Figure 11:
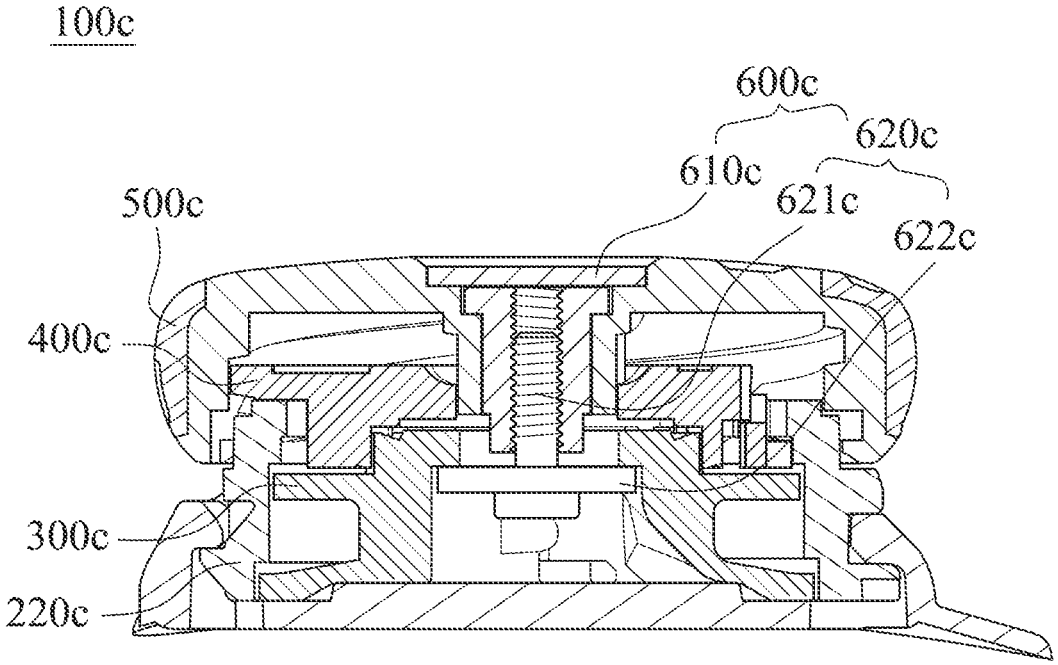
FIG. 11 shows a cross-sectional view of the fastening device of FIG. 10.

Please refer to FIG. 10 and FIG. 11. FIG. 10 shows a three-dimensional exploded view of a fastening device 100*c* according to a fourth embodiment of the present disclosure. FIG. 11 shows a cross-sectional view of the fastening device 100*c* of FIG. 10.

The fastening device 100*c* includes a case unit (not shown), a spool 300*c*, a driving unit 400*c*, a knob 500*c* and a connecting unit 600*c*. The structure and relation of the case unit, the spool 300*c*, the driving unit 400*c* and the knob 500*c* are similar to that of the case unit, the spool 300*b*, the driving unit 400*b* and the knob 500*b* in the third embodiment, but the structure of the connecting unit 600*c* is different from the connecting unit 600*b* of the third embodiment.

Precisely, the first part set of the connecting unit 600*c* includes a fastening barrel 610*c*, and the second part set includes a screw bar 620*c*. The screw bar 620*c* includes a head portion 622*c* and a bar portion 621*c*, and the bar portion 621*c* is connected to the head portion 622*c*. The bar portion 621*c* inserts in the axial space to fasten the fastening barrel 610*c*, and the head portion 622*c* is limited within the large-diameter segment. In configuration, the diameter of the head portion 622*c* can be larger than the diameter of the small-diameter segment, and the diameter of the screw bar 620*c* is smaller than the large-diameter segment, such that the screw bar 620*c* can be limited within the large-diameter segment, thereby completing combination of the knob 500*c*, the driving unit 400*c*, the spool 300*c* and the annular wall 220*c*. As pulling the lace to rotate the spool 300*c* in the loosening direction, the spool 300*c* may rub against the second part set, and therefore the fastening force between the screw bar 620*c* and the fastening barrel 610*c* can be enlarged when fastening the screw bar 620*c*. For example, the teeth pitch thereof can be widened, or a glue can be dispended thereon, which avoids rotation of the second part set caused by friction and separation between the first part set and the second part set.

In other embodiments, the connecting unit can have a boss structure, which can be integrally connected to the knob and can protrude into the axial space, or it can be secured on the knob by adhesion of glue. The connecting unit can include a lower flange, and with the upper end connected to the knob and the lower flanged limited within the large-diameter segment, the combination of the knob, the driving unit, the spool and the annular wall can be completed.

Although the invention has been described in considerable detail with reference to certain embodiments thereof, other embodiments are possible. Therefore, the spirit and scope of the appended claims should not be limited to the description of the embodiments contained herein. It will be apparent to those skilled in the art that various modifications and variations can be made to the structure of the invention without departing from the scope or spirit of the disclosure. In view of the foregoing, it is intended that the invention covers modifications and variations of this disclosure provided they fall within the scope of the following claims.

What is claimed is:

1. A fastening device, comprising:

a case unit, having a radial direction and an axial direction and comprising:

an annular wall, surrounding an inner space; and a base, detachably assembled with the annular wall;

a spool, within the inner space and comprising an axial space, the axial space comprising a large-diameter segment and a small-diameter segment, the small-diameter segment connected to the large-diameter segment along the axial direction;

a driving unit, disposed above the spool along the axial direction, the driving unit selectively prohibiting the spool from rotating in a loosening direction;

a knob, disposed above the driving unit along the axial direction, the knob coupled to the driving unit; and a connecting unit, comprising:

a first part set, connected to the knob; and a second part set, inserting in the axial space to connect to the first part set, and the second part set being limited within the large-diameter segment and being free from restricting by other elements in the large-diameter segment;

wherein the connecting unit does not contact the base and the annular wall directly, and rotating the knob in the loosening direction causes the driving unit to move upward and allows the spool to release a lace.

2. The fastening device of claim 1, wherein the first part set comprises a screw bar, the second part set comprises a connecting barrel, the connecting barrel comprises a top portion and a barrel body portion, the barrel body portion is connected to the top portion, the barrel body portion passes through the small-diameter segment and is configured for the screw bar to screw therewith, the top portion is limited within the large-diameter segment.

3. The fastening device of claim 2, wherein the knob comprises a boss protruding toward the inner space along the axial direction, the barrel body portion is engaged with the boss, thereby allowing the connecting barrel to move simultaneously with the knob.

4. The fastening device of claim 1, wherein the first part set comprises a fastening barrel, the second part set comprises a stop ring and a screw bar, the stop ring is limited within the large-diameter segment, the screw bar passes through the stop ring and the small-diameter segment to screw with the fastening barrel.

5. The fastening device of claim 4, wherein the fastening barrel comprises a lower engaging portion, the stop ring comprises an inner engaging groove, the inner engaging groove is engaged with the lower engaging portion.

6. The fastening device of claim 5, wherein the knob comprises a boss protruding toward the inner space along the axial direction, the fastening barrel comprises an upper engaging portion connected to the lower engaging portion, and the upper engaging portion is engaged with the boss.

7. The fastening device of claim 4, wherein the fastening barrel comprises a lower end surface, after the screw bar is fastened with the fastening barrel, the stop ring abuts against the lower end surface.

8. The fastening device of claim 1, wherein the first part set comprises a fastening barrel, the second part set comprises a screw bar, the screw bar comprises a head portion and a bar portion, the bar portion is connected to the head portion, the bar portion inserts in the axial space to screw with the fastening barrel, the head portion is limited within the large-diameter segment.

9. The fastening device of claim 1, wherein the case unit further comprises:

an inner annular groove, disposed at a lower end of the annular wall.

10. The fastening device of claim 1, wherein the case unit further comprises:

a stop portion, located at the annular wall and protruding toward the inner space along the radial direction;

wherein the spool is located below the stop portion.

11. A fastening device, comprising:

a case unit, having a radial direction and an axial direction and comprising:

an annular wall, surrounding an inner space; and a base, detachably assembled with the annular wall;

a spool, within the inner space and comprising an axial space, the axial space comprising a large-diameter segment and a small-diameter segment, the small-diameter segment connected to the large-diameter segment along the axial direction;

a driving unit, disposed above the spool along the axial direction, the driving unit selectively prohibiting the spool from rotating in a loosening direction;

a knob, disposed above the driving unit along the axial direction and the knob coupled to the driving unit; and a connecting unit, connected to the knob, and the connecting unit disposed within the axial space and limited within the large-diameter segment and being free from restricting by other elements in the large-diameter segment;

wherein the connecting unit does not contact the base and the annular wall directly, and rotating the knob in the loosening direction causes the driving unit to move upward and allows the spool to release a lace.

12. The fastening device of claim 11, wherein the connecting unit comprises:

a first part set, connected to the knob; and a second part set, disposed within the axial space to connect to the first part set, and the second part set is limited within the large-diameter segment.

13. The fastening device of claim 12, wherein the first part set comprises a screw bar, the second part set comprises a connecting barrel, the connecting barrel comprises a top portion and a barrel body portion, the barrel body portion is connected to the top portion, the barrel body portion passes through the small-diameter segment and is configured for the screw bar to screw therewith, the top portion is limited within the large-diameter segment.

14. The fastening device of claim 13, wherein the knob comprises a boss protruding toward the inner space along the axial direction, the barrel body portion is engaged with the boss, thereby allowing the connecting barrel to move simultaneously with the knob.

15. The fastening device of claim 12, wherein the first part set comprises a fastening barrel, the second part set comprises a stop ring and a screw bar, the stop ring is limited within the large-diameter segment, the screw bar passes through the stop ring and the small-diameter segment to screw with the fastening barrel.

16. The fastening device of claim 15, wherein the fastening barrel comprises a lower engaging portion, the stop ring comprises an inner engaging groove, the inner engaging groove is engaged with the lower engaging portion.

17. The fastening device of claim 16, wherein the knob comprises a boss protruding toward the inner space along the axial, the fastening barrel comprises an upper engaging portion connected to the lower engaging portion, and the upper engaging portion is engaged with the boss.

18. The fastening device of claim 15, wherein the fastening barrel comprises a lower end surface, after the screw bar is fastened with the fastening barrel, the stop ring abuts against the lower end surface.

19. The fastening device of claim 12, wherein the first part set comprises a fastening barrel, the second part set comprises a screw bar, the screw bar comprises a head portion and a bar portion, the bar portion is connected to the head portion, the bar portion inserts in the axial space to screw with the fastening barrel, the head portion is limited within the large-diameter segment.

20. The fastening device of claim 11, wherein the case unit further comprises:

a stop portion, located at the annular wall and protruding toward the inner space along the radial direction;

wherein the spool is located below the stop portion.

* * * * *